United States Patent [19]

Takeda et al.

[11] Patent Number: 5,035,683

[45] Date of Patent: Jul. 30, 1991

[54] FOLDING DEVICE IN A CORRUGATED CARDBOARD BOX MAKING MACHINE

[75] Inventors: Junichi Takeda, Hakui; Haruo Yoshizuka, Kanazawa, both of Japan

[73] Assignee: Kabushiki Kaisha Ishikawa Seisakusho Ltd., Kanazawa, Japan

[21] Appl. No.: 505,132

[22] Filed: Apr. 5, 1990

[30] Foreign Application Priority Data

Apr. 7, 1989 [JP] Japan ..... 1-88574

[51] Int. Cl.[5] ..... B31B 1/58

[52] U.S. Cl. ..... 493/23; 493/34; 493/179; 493/479; 493/178

[58] Field of Search ..... 493/1, 2, 20, 23, 30, 493/34, 178, 179, 423, 478, 479

[56] References Cited

U.S. PATENT DOCUMENTS

| | | | |
|---|---|---|---|
| 2,982,189 | 5/1961 | Shields | 493/30 |
| 3,611,884 | 10/1971 | Hottendorf | 493/479 |
| 4,551,124 | 11/1985 | Mowry | 493/479 |
| 4,554,777 | 11/1985 | Denk et al. | 493/478 |

FOREIGN PATENT DOCUMENTS

| | | | |
|---|---|---|---|
| 0133823 | 10/1985 | European Pat. Off. | 493/1 |
| 3428427 | 2/1985 | Fed. Rep. of Germany | 493/1 |

*Primary Examiner*—Frederick R. Schmidt
*Assistant Examiner*—J. Addison Marlott
*Attorney, Agent, or Firm*—Burns, Doane, Swecker & Mathis

[57] ABSTRACT

The present invention relates to a folding device in a corrugated cardboard box making machine which is capable of adapting to a thickness of a corrugated cardboard sheet by regulating a space between a folding belt and an upper guide, and also capable of accurately making folding width of the corrugated cardboard sheet by regulating the position of a gauge belt. Having main transporting means for simultaneously positioning the folding belt, upper guide and gauge belt, the device is provided with an upper guide transporting means for independently regulating the position of the upper guide and a gauge belt transporting means for independently regulating the position of the gauge belt. The device is further provided with a control means for controlling the drive means and the gauge belt transporting of the upper guide transporting means.

2 Claims, 5 Drawing Sheets

FOLDING DEVICE IN A CORRUGATED CARDBOARD BOX MAKING MACHINE

BACKGROUND OF THE INVENTION

Field of the Invention

The present invention relates to a folding device in a corrugated cardboard box making machine. In FIGS. 1 and 2, there is shown a fundamental structure of the corrugated cardboard box making machine. FIG. 1 shows a series of states how a corrugated cardboard sheet S fed to a folding unit section of the corrugated cardboard box making machine is formed into a corrugated cardboard box S'.

The corrugated cardboard sheet S supplied to a slotter section A of the corrugated cardboard making machine is slotted and creasing lines are formed thereon. Then, both side portions of the sheet S forwarded to the folding unit section B is folded at a right angle, and thereafter, it is flatly folded to form a corrugated cardboard box S'. The cardboard box S' is then transported into a discharge section C.

In a preceding process B1 at the folding unit section B, the corrugated cardboard sheet S is folded along the creasing lines p—p and q—q. A state showing how the sheet S is folded is shown by II and III in the FIG. 1.

In FIG. 6, there is shown a conventional structure whereby the sheet S is folded. In the FIG. 6, a reference numeral 33 designates a belt supporting member which supports a folding belt 1 and a transport belt 10. A reference numeral 32 represents a screw shaft which moves the belt supporting member 33 in the axial direction of the shaft 32 and is supported by frame 18. A reference numeral 31 designates a motor provided for rotatively driving the screw shaft 32. Accordingly, when the motor 31 is rotated, the folding belt 1 and the transport belt 10 are moved in the axial direction of the shaft 32 to be positioned at a suitable position for folding work of the sheet S.

A reference numeral 8 represents a guide supporting member on which an upper guide 5 is attached. A reference numeral 38 designates a screw shaft for moving the guide supporting member 8 in the axial direction of the shaft 32 and is supported by the frame 18. A reference numeral 37 designates a chain transmission mechanism for transmitting the rotation of the screw shaft 32 to the screw shaft 38. Both of the shafts 32 and 38 are simultaneously rotated in the same rotational frequency.

A reference numeral 51 represents a regulating means for finely regulating a position of the guide supporting member 8 in the axial direction of the shaft 32. The regulating means 51 is similar to a regulating means 53 illustrated in FIG. 7 which will be described below, and therefore, description on the regulating means 51 is omitted.

When the motor 31 is rotated, the rotatory power of the motor is transmitted to the screw shaft 32, the chain transmission mechanism 37, and the screw shaft 38 subsequently in this order to move the guide supporting member 8 in the axial direction of the shaft 32. The upper guide 5 is positioned at a standard position suitable for folding the sheet S.

As illustrated in the FIG. 6, the corrugated cardboard sheet S is folded by the folding belt 1 and the upper guide 5, and at a final stage of the process B1, both side portions of the sheet S are folded at a right angle.

There are various sizes of corrugated cardboard boxes that are manufactured by the corrugated cardboard box making machine. Accordingly, the positions of creasing lines by which the sheets S are folded vary according to the sizes and kinds of the boxes to be manufactured. It is, therefore, arranged to position the folding belt 1 and the upper guide 5 at a suitable position by simultaneously moving them with rotation of the motor 31 as described above in order to adapt for the manufacture of various kinds of corrugated cardboard boxes.

Corrugated cardboard sheets S vary in thickness, and therefore, it is necessary to adjust a space between the folding belt 1 and the upper guide 5 to adapt for the thickness of a corrugated cardboard sheet S. The regulating means 51 is therefore provided to independently move the guide supporting member 8 for making the space a most suitable value.

In the succeeding process B2 at the folding unit section B, the folded portions at both sides of the sheet S are inwardly pressed from both sides and the sheet S is flatly folded down. The flatly folded state is illustrated by IV and V in the FIG. 1.

In FIG. 7, there is shown a conventional structure whereby a corrugated cardboard sheet S is folded and a sheet folding width is rectified. In the FIG. 7, reference numerals 10 and 1 represent a transport belt and a folding belt respectively. The folding belt 1 changes the posture of its angle of inclination from the vertical posture as shown in the FIG. 6 to the horizontal posture as shown in the FIG. 7 by gradual inclination. With this action, the sheet S is caught in a space between the folding belt 1 and the transport belt 10, and the sheet S is folded down along the creasing lines p—p, q—q.

A reference numeral 15 represents a gauge belt supporting member and a gauge belt 11 is supported thereat through a roller 14. The gauge belt supporting member 15 moves simultaneously with the belt supporting member 33 (refer to FIG. 6) for the same amount of distance in the axial direction of the shaft 32. There is arranged a regulating means 53 for finely regulating the position of the gauge belt supporting member 15 relative to the belt supporting member 33. The regulating means 53 is provided with a screw shaft 44, and a handle 43 is attached to one end of the screw shaft 44.

A reference numeral 49 designates a nut to which a pointer 48 is fixed, and the nut 49 is also screwed in the screw shaft 44. A reference numeral 47 represents a scale which is fixed on the belt supporting member 33. When the handle 43 is rotated by an operator, the gauge belt 11 and the pointer 48 are moved simultaneously, and the operator is able to position the gauge belt 11 to a position most suitable for the folding width of the sheet S by watching graduations on the scale 47 to which the pointer 48 indicates.

The gauge belt 11 is provided to rectify a folding width by pressing the folding sections of the sheet S from both sides. A required folding width of the corrugated cardboard box S' varies, and therefore, it is arranged to rectify the position of the gauge belt 11 in accordance with a folding requirement.

In the prior art described above, there exists the following problems.

A first problem is that the working efficiency is lowered when a set of boxes being processed is changed to another set of boxes thereby worsening the working ratio of the corrugated cardboard box making machine which will be described more in detail as follows.

Because of market diversification in recent years, the requirement for manufacturing varieties of boxes in small quantity per lot with delivery in a short period of time is strongly called for from the manufacturers of corrugated cardboard boxes. In order to comply with this requirement, it is required to quickly and frequently perform operations of changing over a set of boxes being processed to another set of boxes. In the prior art, rough positioning of the folding belt 1, transport belt 10, upper guide 5, and gauge belt 11 can be quickly conducted. However, the operation for regulating a space between the folding belt 1 and the upper guide 5, and the operation for regulating a position of the gauge belt 11 are being conducted manually by operator. Moreover, this requires the operator to position the upper guide 5 and gauge belt 11 by operating the handle, carefully watching graduations to which the pointer 48 on the scale 47 indicates. Such operations are complicated and take a long period of time.

In the corrugated cardboard box making machine, when a set of boxes being conducted is changed over to another set of boxes, a printing plate exchange operation and an ink changing operation are conducted in the printing unit section, and in the slotter unit section, an operation for changing the positions of slotting blades is carried out. Further, in the folding unit section, it is required to move the upper guide 5, gauge belt 11 and the like in the axial direction of the shaft 32. When a set of boxes being processed is changed over to another set of boxes, it will be more advantageous if other operations are carried out at the same time while the exchange operations of printing plate and ink changing operations are automatically conducted which generally takes a long period of time. However, among said operations, it takes a long time for positioning and regulating the positions of the upper guide 5 and gauge belt 11 by operating the handle, and even after the exchange operation of printing plate and ink changing operation are completed, it sometimes happens that the regulating and positioning operations are not finished. As a result, it takes a long period of time for changing over a set of boxes and the working ratio of the machine is lowered.

A second problem is that accuracy for manufacturing boxes is not stabilized, and consequently, it lowers the quality of boxes and badly affects a packing process which will now be described more concretely below.

The positioning and regulating operations of the upper guide 5 and gauge belt 11 are manually conducted and it is required to perform the operations in a short period of time. It is, therefore, difficult to accurately conduct the operations. Consequently, irregularity in the outcome of the operations occur, and the positions of the upper guide 5 and gauge belt 11 are made inaccurate. In this case, the accuracy in the folding width of folded corrugated cardboard boxes is worsened.

The next process for a packing operation is generally automated. If, therefore, corrugated cardboard boxes of inaccurate folding width are forwarded to a packing machine, there arise such problems as follows.

When the folding width of the corrugated cardboard boxes is wider than a standard width, claws of the packing machine can not get into a gap between a packing case, which packs the folded corrugated cardboard boxes, and the corrugated cardboard boxes since the gap becomes smaller, and the packing operation can not be carried out. On the other hand, when the folding width of the corrugated cardboard boxes is narrower than the standard width, a bigger gap is made between the packing case which packs the folded corrugated cardboard boxes and the corrugated cardboard boxes, and dust easily gets into the gap.

SUMMARY OF THE INVENTION

An object of the present invention is to provide a folding device capable of quickly regulating a folding width of corrugated cardboard boxes when a set of boxes being processed is changed over to another set of boxes so that the working ratio of the machine is improved.

Another object of the present invention is to provide a folding device capable of accurately regulating the folding width of corrugated cardboard boxes for manufacturing high quality corrugated cardboard boxes and smoothly performing the next packing process.

In order to accomplish the above-mentioned objects, the folding device in the corrugated cardboard box making machine of the present invention is comprised of the following means:

folding belts for folding both side portions of a corrugated cardboard sheet along creasing lines and folding down the sheet;

upper guides for folding both side portions of the corrugated cardboard sheet at a right angle between the folding belt;

gauge belts for regulating the folding width of the folded corrugated cardboard sheet;

belt supporting members for supporting the folding belt;

guide supporting members for supporting the upper guide;

gauge belt supporting members for supporting the gauge belt;

main transporting means for positioning the belt supporting member, guide supporting member, gauge belt supporting member at predetermined positions;

upper guide transporting means for moving the guide supporting member independently relative to the belt supporting means and positioning at a predetermined position;

gauge belt transporting means for moving the gauge belt supporting member independently relative to the belt supporting member and positioning at a predetermined position; and control means for controlling the drive of the upper guide transporting means and the gauge belt transporting means based on the data stored on the amount of transport of the upper guide and the amount of transport of the gauge belt.

The main transport means is comprised of motor 31, screw shaft 32, chain transmission mechanism 37, screw shaft 38, nut 60, and movable supporting member 29 in an embodiment. The upper guide transport means comprises a motor 7, spline shaft 6, gear 63, nut 60, and screw shaft 38 in the embodiment. Further, the gauge belt transport means is comprised of a motor 13 and screw shaft 12 in the embodiment.

These and other objects and features of the present invention will become more apparent from the following description taken in conjunction with the preferred embodiment thereof with reference to the accompanying drawings.

DESCRIPTION OF THE PREFERRED EMBODIMENT

The fundamental structure of a folding unit section B of a corrugated cardboard box making machine has already been described above referring to the FIGS. 1 and 2. In the folding unit section B, a corrugated cardboard sheet S is folded and then folded down as shown in the FIG. 1 on which description has also been made above.

Figure 3:
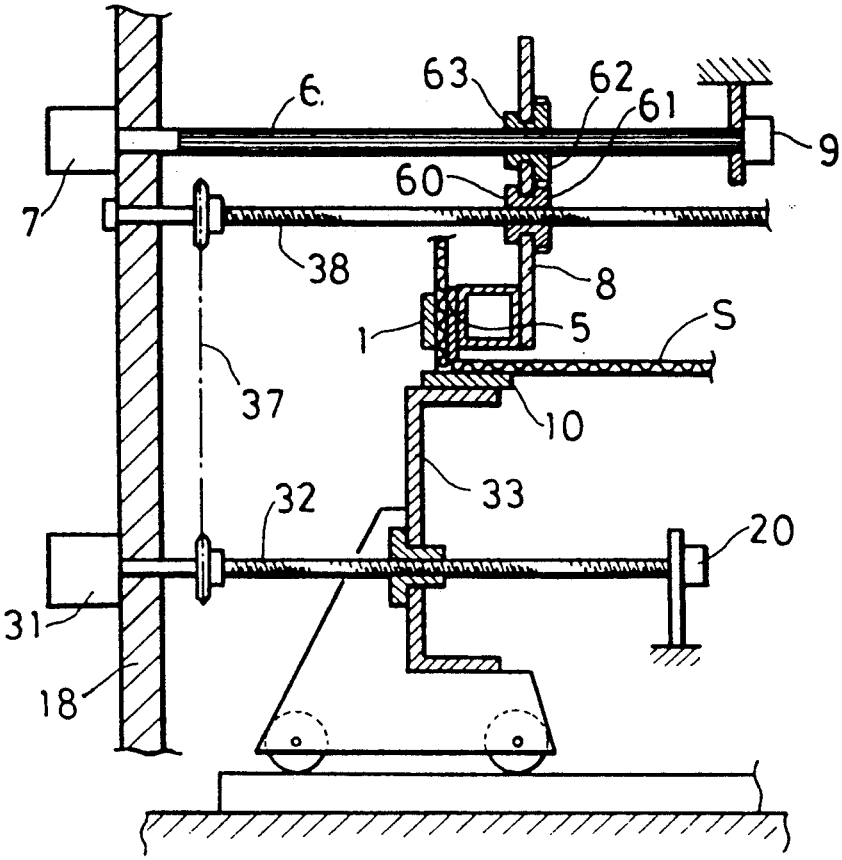
FIG. 3 is a cross-sectional view showing a portion of a preceding process in a folding unit section of the corrugated cardboard box making machine.
Figure 6:
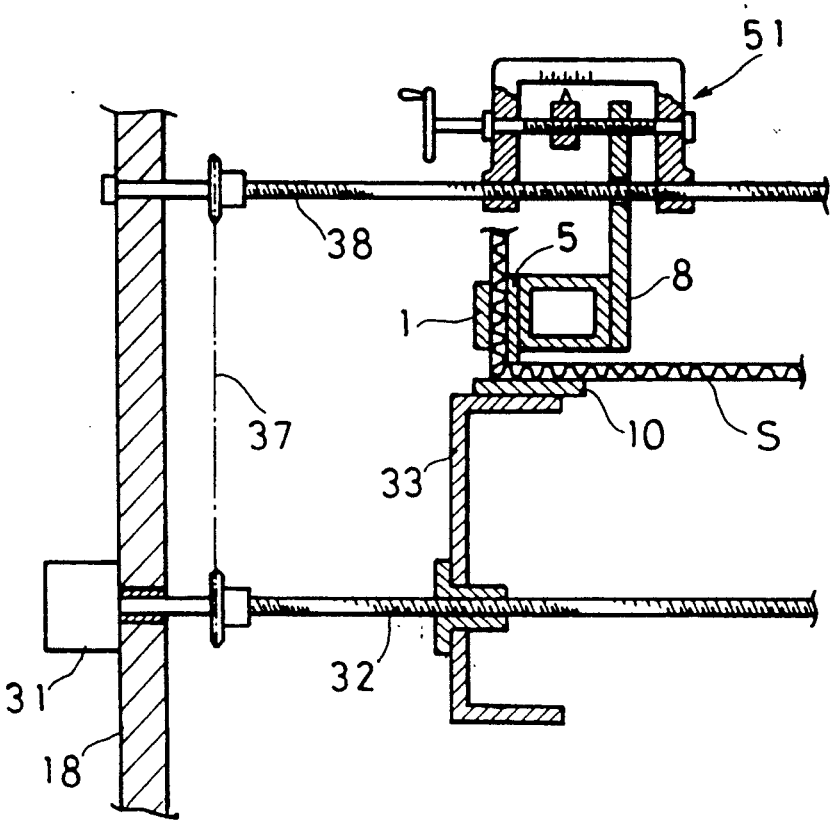
FIG.6 PRIOR ART
FIG. 6 is a cross-sectional view showing a portion of a preceding process in a folding unit section of a conventional corrugated cardboard box making machine.

FIG. 3 shows a structure for folding the sheet S. In the FIG. 3, a reference numeral 18 represents a frame, 33 a belt supporting member, 1 a folding belt, 10 a transport belt, 32 a screw shaft for moving the belt supporting member 33, 31 a motor for rotatively driving the screw shaft 32, 8 a guide supporting member, 5 an upper guide, 38 a screw shaft for moving the guide supporting member 8, and 37 a chain transmission mechanism for transmitting the rotation of the screw shaft 32 to the screw shaft 38. These structural elements are similar to those of the conventional structure as shown in the FIG. 6.

To one end of the screw shaft 32, an encoder 20 is attached so as to be able to measure the amount of rotation of the screw shaft 32.

At the portion adjacent to the upper end of the guide supporting member 8, a nut 60 provided with a gear tooth section 61 is attached. The nut 60 is attached in a manner that its movement in the axial direction of the shaft 32 is restrained relative to the guide supporting member 8. The nut 60 is also rotatably attached relative to the guide supporting member 8, and is screwed in the screw shaft 38.

A reference numeral 6 designates a spline shaft. To one end of the spline shaft 6, a regulating motor 7 is connected, and an encoder 9 is fixed to another end of the spline shaft 6. The amount of rotation of the spline shaft 6 can be measured by the encoder 9. At the upper end portion of the guide supporting member 8, a rotative member, such as a gear, 63 is attached. The gear 63 is provided with a gear tooth section 62 engaging with the gear tooth section 61. The gear 63 is attached in a manner that its movement in the axial direction of the shaft 32 is restrained relative to the guide supporting member 8. The gear 63 is rotatably attached with respect to the guide supporting member 8. Further, the gear 63 is fitted into the spline shaft 6. Accordingly, the gear 63 is rotated unitedly with the spline shaft 6, and at the same time, it can be moved along the spline shaft 6.

The folding belt 1 is arranged for folding both sides of the sheet S along the creasing lines p—p, q—q by raising both side portions of the sheet S from the horizontal direction to the vertical direction (preceding process B1 in the folding section B), and further folding down the portion substantially folded at right angle by inwardly pressing the sheet from both sides (succeeding process B2 in the folding unit section B). The folding belt 1 is therefore stretched so as to change its angle of inclination as illustrated in the FIGS. 1 and 2. In other words, the folding belt 1 is stretched over the guide roller 2 at a starting point side and the guide roller 3 at an ending point side disposed on both sides of the folding unit section B with a tension roller 4 provided therebetween. At the position near the guide roller 2 at the starting point side, the posture of the folding belt 1 is in the horizontal direction. At an intermediate position near the tension roller 4, the posture of the folding belt 1 is in a vertical state. More specifically, the folding belt 1 gradually changes its posture from horizontal to vertical direction when it moves from the starting point toward the intermediate position. Further, at the ending point side near the guide roller 3, the posture of the folding belt 1 is in the horizontal direction. From the intermediate point portion toward the ending point portion, the posture of the folding belt 1 gradually declines inwardly from the vertical direction.

The upper guide 5 is disposed at the portion of the preceding process B1 in the folding unit section B to support the portion of the creasing lines from inside when the corrugated cardboard sheet S is folded from outside toward inside by the folding belt 1.

The transport belt 10 is arranged for transporting the sheet S received from the slotter unit section A to cover the overall length of the folding unit section B in order to deliver the folded corrugated cardboard box S' to a discharge section C. Above the transport belt 10, the folding belt 1 and the upper guide 5 are positioned, and there is provided a gap between the folding belt 1 the transport belt 10 so that the sheet S can pass through therebetween.

Figure 4:
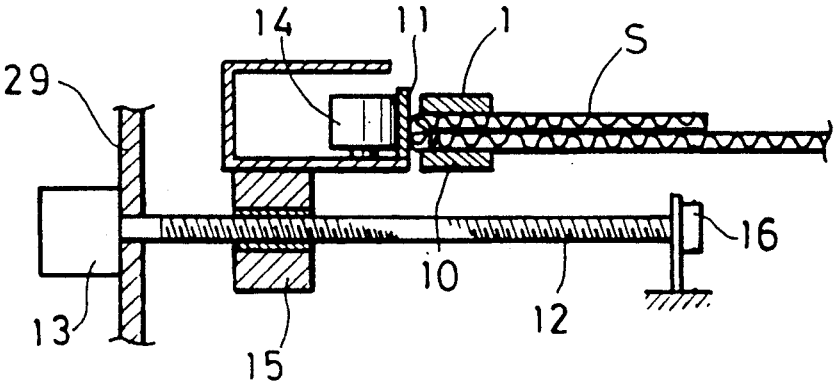
FIG. 4 is a cross-sectional view showing a portion of a succeeding process in the folding unit section of the corrugated cardboard box making machine.
Figure 7:
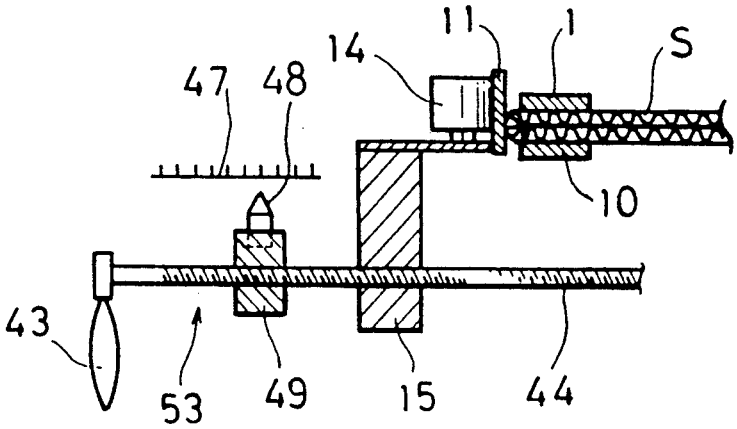
FIG.7 PRIOR ART
FIG. 7 is a cross-sectional view showing a portion of a succeeding process in the folding unit section of the conventional corrugated cardboard box making machine.

The FIG. 4 shows a structure arranged for folding the sheet S and regulating a folding width of the sheet S. In the FIG. 4, a reference numeral 10 represents the transport belt, 1 the folding belt, 15 a gauge belt supporting member, 11 a gauge belt, and 14 a roller for stretching the gauge belt 11. These structural elements are similar to those of a conventional structure as shown in the FIG. 7.

In the FIG. 4, a reference numeral 12 represents a screw shaft for moving the gauge belt supporting member 15 in the axial direction of the shaft 32. A reference numeral 29 designates a movable supporting member supported by a frame 19 and is arranged to move simultaneously with the belt supporting member 33. The screw shaft 12 is supported by the movable supporting member 29, and to one end of the screw shaft 12, a positioning motor 13 is connected, while an encoder 16 is fixed to another end of the shaft 12. The amount of rotation of the screw shaft 12 can be measured by the encoder 16.

Figure 5:
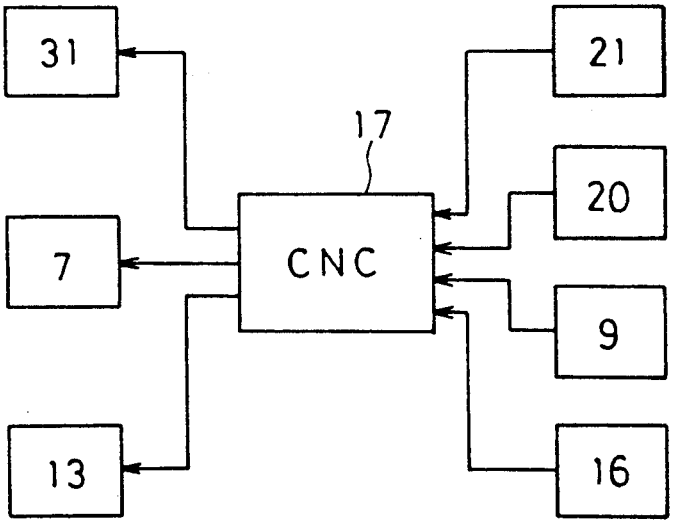
FIG. 5 is a block diagram of the control system.

The FIG. 5 shows the control system for controlling the motor 31,31, regulating motor 7,7, and positioning motor 13,13. A reference numeral 17 represents a control means (CNC) comprised of a microcomputer. The control means 17 stores data of various conditions such as the kind and thickness of the sheets S, folding positions, and folding widths. A signal indicating the kind of corrugated cardboard sheet S is inputted into the control means 17 from operation panel 21. Data signals from each encoder 20,9,16 which show data of the amount of rotation of the screw shaft 32, the spline shaft 6, and the screw shaft 12 are also inputted into the control means 17. On the other hand, signals for driving each motor 31,7,13 are output from the control means 17.

Figure 1:
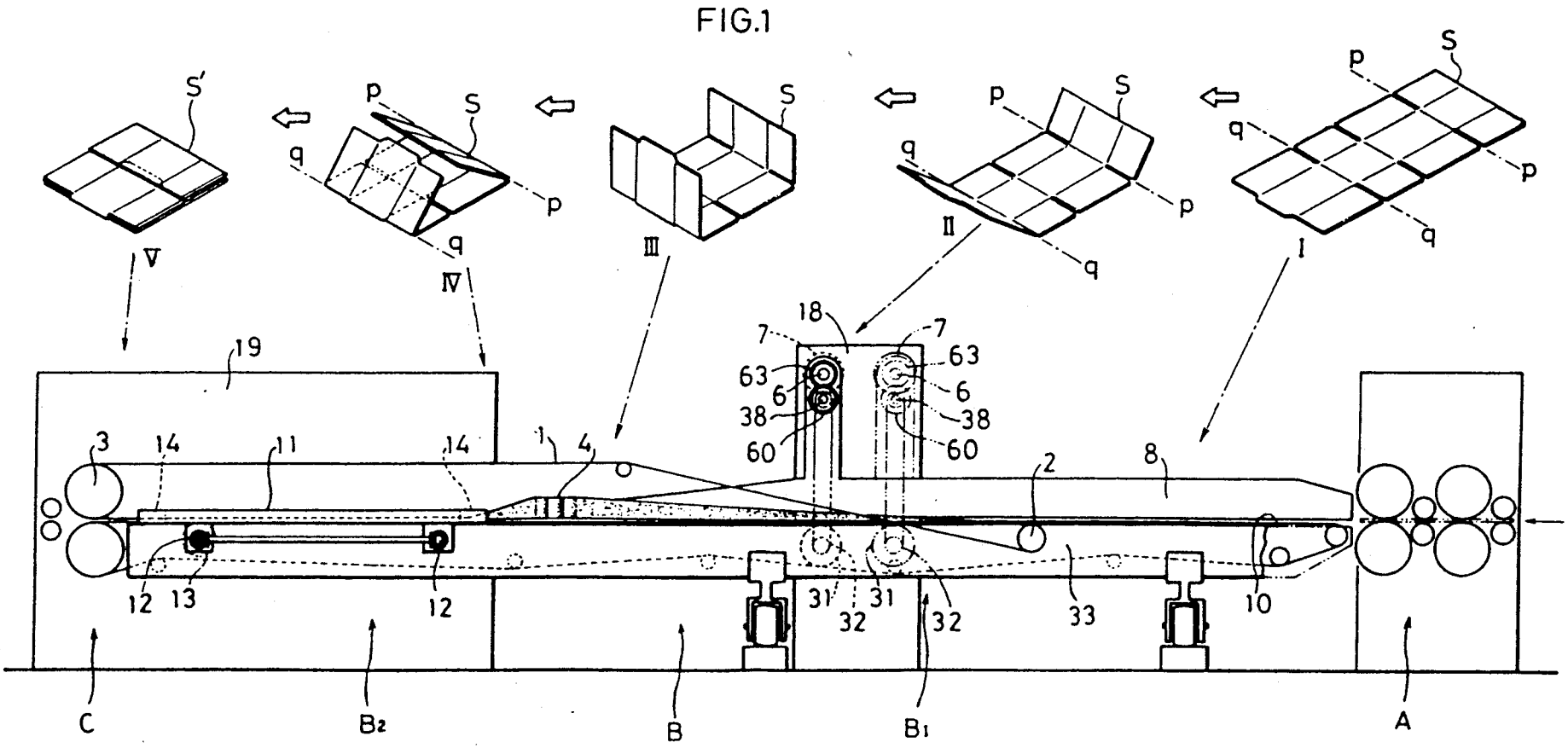
FIG. 1 is a front view of a corrugated cardboard box making machine in an embodiment of the present invention with perspective views showing a series of states how a corrugated cardboard sheet is formed.
Figure 2:
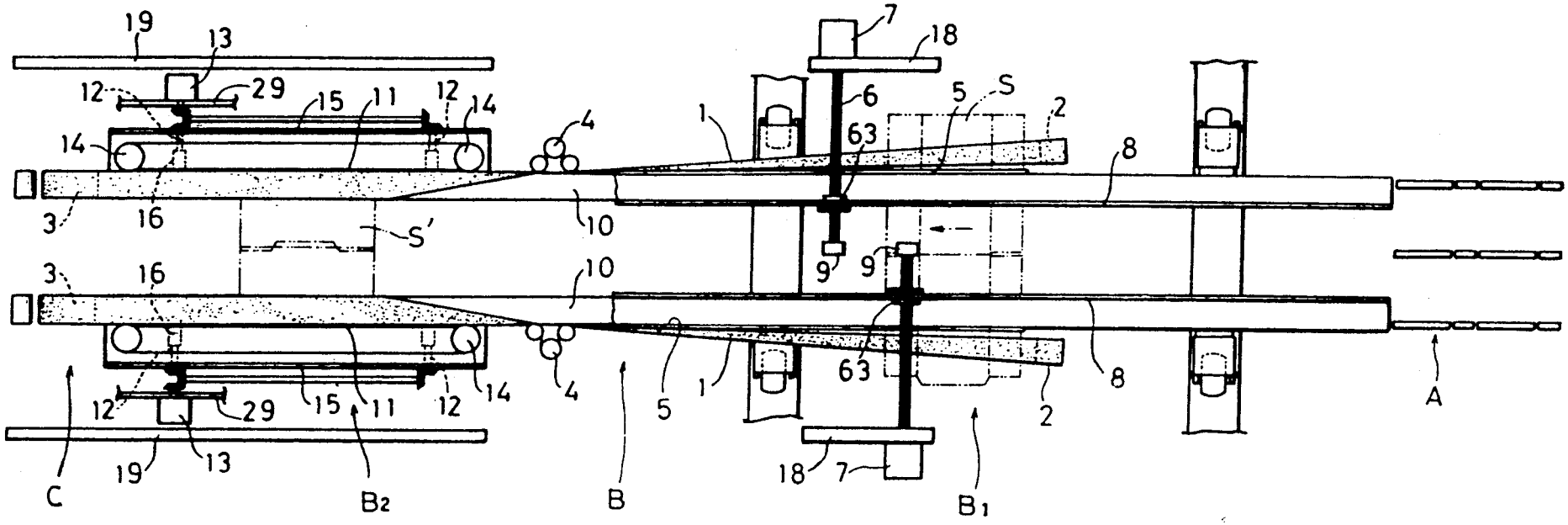
FIG. 2 is a plan view of the corrugated cardboard box making machine.

Now, description will be made on the actions of the device described above. As shown in FIGS. 1 and 2, the sheet S on which creasing lines and slots are formed in the slotter unit section A is placed on the transport belts 10,10, and transported into the folding unit section B.

In the preceding process B1 which is performed in the folding unit section B, both side portions of the sheet S are made in a vertical state by gradually raising their posture from horizontal state along an inclined plane of the folding belts 1,1, and the sheet S is transported to a section adjacent to the upper guide 5,5 (refer to FIGS. I,II,III in the FIG. 1). Both side portions of the sheet S are caught inbetween the folding belt 1,1 and the upper guide 5,5, and both side portions of the sheet S are folded hereat at a right angle as shown by FIG. III in the FIG. 1.

In the succeeding process B2 which is performed in the folding unit section B, both side portions of the sheet S are pressed from outside by the folding belt 1,1 and are gradually inclined inwardly to be flatly folded down (refer to FIGS. IV and V in the FIG. 1). Thereafter, the sheet S is pressed from both sides and its folding width is rectified by a pair of the gauge belts 11,11.

The corrugated cardboard box S' thus completely manufactured is transported to the discharge section C.

When a process for a certain kind of corrugated cardboard box is finished and the process is changed over to another kind of corrugated cardboard box, in other words, when a set of a certain product under process is changed over to a set of another kind of product, it is required to rectify the positions of the folding belt 1,1, transport belt 10,10, upper guide 5,5 and gauge belt 11,11 based on the size of creasing lines of the sheet S. Necessary data on the corrugated cardboard box which is to be put on the next process are therefore inputted into the control means 17 by operating the operation panel 21. Based on the data, signals are output to each motor 31,7,13 from the control means 17.

Positioning of the folding belt 1,1, transport belt 10,10, upper guide 5,5 and gauge belt 11,11 is roughly performed by driving the motor 31. On receipt of an output signal from the control means 17, the motor 31 starts rotation and the screw shaft 32 is rotated whereby the belt supporting member 33 is moved in the axial direction of the shaft 32. At the same time, the rotation of the screw shaft 32 is transmitted to the screw shaft 38 through the chain transmission mechanism 37 to move the nut 60 in the axial direction of the shaft 32. The gear tooth section 61 of the nut 60 is engaged with the gear tooth section 62 of the gear 63 which is not being rotated, and therefore, the nut 60 can be moved in the axial direction of the shaft 32 with rotation of the screw shaft 38. With movement of the nut 60, the guide supporting member 8 is moved in the axial direction of the shaft 32. Accordingly, the folding belt 1 and the transport belt 10 supported by the belt supporting member 33, and the upper guide 5 supported by the guide supporting member 8 are simultaneously moved in the same distance and positioned at predetermined positions. The movable supporting member 29 is also moved correlatively with the movement of the belt supporting member 33, and the gauge belt 11 is positioned at a predetermined position.

Then, an output signal is transmitted to the regulating motor 7 from the control means 17 in order to finely regulate the position of the upper guide 5. With rotation of the regulating motor 7, the spline shaft 6 is rotated, and the gear 63 is thereby rotated. The rotation of the gear 63 is transmitted to the nut 60 through engagement of the gear tooth section 62 with the gear tooth section 61. Since the screw shaft 38 is not being rotated, the nut 60 moves in the axial direction of the shaft 32 and moves the guide supporting member 8 to a predetermined position. The positioning of the upper guide 5 is thus performed, and the space between the upper guide 5 and the folding belt 1 is set accurately.

Fine regulation for the position of the gauge belt 11 is conducted by transmitting an output signal to the positioning motor 13 from the control means 17. With rotation of the positioning motor 13, the screw shaft 12 is rotated and the gauge belt supporting member 15 is correlatively moved to a predetermined position. The position of the gauge belt 11 is thus regulated.

The amount of movement of the belt supporting member 33, the amount of independent movement of the guide supporting member 8, and the amount of independent movement of the gauge belt supporting member 15 are measured by the encoder 20, encoder 9 and encoder 16 respectively and inputted into the control means 17. The control means 17 compares the values measured by the encoders 20, 9, and 16 with data for various conditions preliminarily stored, and when the predetermined conditions are satisfied, it stops each motor 31, 7 and 13. With such control by the control means 17, the transport belt 10, folding belt 1, upper guide 5 and gauge belt 11 are roughly positioned, and then the positions of the upper guide 5 and gauge belt 11 are regulated accurately.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A folding device in a corrugated cardboard box making machine, comprising:

a folding belt for folding a side portion of a corrugated cardboard sheet along a creasing line and folding down the sheet;

an upper guide for folding a side portion of the corrugated cardboard sheet at a right angle between the folding belt and the upper guide;

a gauge belt for regulating the folding width of the folded corrugated cardboard sheet;

a belt supporting member for supporting the folding belt;

a guide supporting member for supporting the upper guide;

a gauge belt supporting member for supporting the gauge belt;

main transporting means for positioning the belt supporting member, the guide supporting member, and the gauge belt supporting member at predetermined positions;

upper guide transporting means for moving the guide supporting member independently relative to the belt supporting member and positioning the guide supporting member at a predetermined position;

gauge belt transporting means for moving the gauge belt supporting member independently relative to the belt supporting member and positioning the gauge belt supporting member at a predetermined position; and control means for controlling the main transporting means, the upper guide transporting means, and the gauge belt transporting means, said control means including:

means for storing data on the amount of transport of the upper guide and the amount of transport of the gauge belt;

means for first driving the main transporting means so as to position the belt supporting member, the guide supporting member, and the gauge belt supporting member at predetermined positions; and means for subsequently driving the upper guide transporting means and the gauge belt transporting means so as to move the guide supporting member and the gauge belt supporting member, respectively, independently of the belt supporting member based on the stored data.

2. A folding device in a corrugated cardboard box making machine, comprising:

a folding belt for folding a side portion of a corrugated cardboard sheet along a creasing line and folding down the sheet;

an upper guide for folding a side portion of the corrugated cardboard sheet at a right angle between the folding belt and the upper guide;

a gauge belt for regulating the folding width of the folded corrugated cardboard sheet;

a belt supporting member for supporting the folding belt;

a guide supporting member for supporting the upper guide;

a gauge belt supporting member for supporting the gauge belt;

main transporting means for positioning the belt supporting member, the guide supporting member, and the gauge belt supporting member at predetermined positions;

upper guide transporting means for moving the guide supporting member independently relative to the belt supporting member and positioning the guide supporting member at a predetermined position;

gauge belt transporting means for moving the gauge belt supporting member independently relative to the belt supporting member and positioning the gauge belt supporting member at a predetermined position;

control means wherein data on the amount of transport of the upper guide and the amount of transport of the gauge belt are stored for controlling the drive of the upper guide transporting means and the gauge belt transporting means;

a first screw shaft to be screwed in the belt supporting member;

a nut attached to the guide supporting member;

a second screw shaft to be screwed in the nut;

a motor connected to either one of the screw shafts;

transmitting means for transmitting the rotation of one of the screw shafts to another one of the screw shafts;

a rotative member attached to the guide supporting member;

a third shaft fitted in the rotative member so that the rotative member can move axially with respect to the third shaft and wherein the rotative member is rotatably fixed with respect to the third shaft;

a motor connected to said third shaft; and rotation transmitting means for interactively transmitting the rotation of the nut and the rotative member.

* * * * *